US007191620B2

(12) United States Patent
Jürgens et al.

(10) Patent No.: US 7,191,620 B2
(45) Date of Patent: Mar. 20, 2007

(54) LATCH NEEDLE

(75) Inventors: Eric Jürgens, Bisingen (DE); Andreas Dietz, Balingen (DE); Wolfgang Schmoll, Haigerloch (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 11/243,431

(22) Filed: Oct. 5, 2005

(65) Prior Publication Data

US 2006/0075788 A1 Apr. 13, 2006

(30) Foreign Application Priority Data

Oct. 8, 2004 (DE) ..... 10 2004 049 061

(51) Int. Cl.
*D04B 35/04* (2006.01)

(52) U.S. Cl. ..... 66/121

(58) Field of Classification Search ..... 66/121, 66/122, 117

See application file for complete search history.

(56) References Cited

U.S. PATENT DOCUMENTS

| | | | | |
|---|---|---|---|---|
| 2,044,324 A | | 6/1936 | Page | |
| 2,252,302 A | * | 8/1941 | Morith | 66/117 |
| 3,453,845 A | | 7/1969 | Blackwell | |
| 4,791,794 A | * | 12/1988 | Schmoll | 66/121 |
| 4,827,739 A | * | 5/1989 | Goller et al. | 66/64 |
| 5,509,280 A | | 4/1996 | Schuler et al. | |
| 5,609,045 A | * | 3/1997 | Schmoll et al. | 66/121 |
| 5,956,976 A | * | 9/1999 | Schaffer et al. | 66/121 |
| 6,439,001 B1 | * | 8/2002 | Schaffer | 66/121 |
| 6,510,714 B2 | | 1/2003 | Dehner | |
| 6,792,775 B2 | * | 9/2004 | Wang | 66/121 |
| 2002/0043083 A1 | * | 4/2002 | Schaffer | 66/121 |

FOREIGN PATENT DOCUMENTS

| | | |
|---|---|---|
| AT | 202 681 | 3/1959 |
| DE | 586 678 | 10/1933 |
| DE | 1 113 537 | 9/1961 |
| DE | 43 24 232 A1 | 1/1965 |
| DE | 1 410 312 | 4/1969 |
| DE | 1 585 437 | 12/1970 |
| DE | 26 50 985 | 5/1977 |
| DE | 27 26 834 | 12/1978 |
| DE | 29 44 300 A1 | 5/1981 |
| DE | 43 34 051 C1 | 2/1995 |
| DE | 44 02 706 C1 | 6/1995 |
| EP | 1 233 092 A1 | 8/2002 |

* cited by examiner

*Primary Examiner*—Danny Worrell
(74) *Attorney, Agent, or Firm*—Norman N. Kunitz; Fitch, Even, Tabin & Flannery

(57) ABSTRACT

The starting point of a new concept in a latch needle (1) is an attachment of the latch spring (22) in the sawslot (9) of the latch needle from the side of the needle back (7). For this purpose the latch needle (1) has spring-supporting pockets (19, 21) accessible from the needle back (7) or other structures adapted to receive the ends (25, 26) of the latch spring (22). The spring-supporting pockets (19, 21) are closed toward the needle back (7) at least to such an extent that the ends (25, 26) of the latch spring (22) are held in a form-locking, or at least in a captive manner in the spring-supporting pockets (19, 21). Such a latch needle has a reduced tolerance sensitivity during manufacture. The described needle concept makes possible further improvements which contribute to the operational safety and service life of the latch needle.

15 Claims, 4 Drawing Sheets

LATCH NEEDLE

CROSS REFERENCE TO RELATED APPLICATION

This application claims the priority of German Patent Application No. 10 2004 049 061.9, filed on Oct. 8, 2004, the subject matter of which, in its entirety, is incorporated herein by reference.

FIELD OF THE INVENTION

The invention relates to a latch needle, particularly a machine knitting needle, provided with a spring-loaded latch.

BACKGROUND OF THE INVENTION

The use of latch needles for forming loops has long been favored to permit a simple loop-forming process. Such a needle is disclosed, for example, in U.S. Pat. No. 3,453,845. The latch needle has a shank which, at one end, has a hook, in front of which a sawslot is formed. A latch, which serves for opening and closing the hook, projects with one end into the sawslot and is pivotally supported therein. The latch may pivot into a closed position in which it lies against the hook tip with its latch spoon. For opening the hook, the latch may swing into its reverse position in which it is pivoted to the farthest possible from the hook and in which it lies on the shank or is disposed at least adjacent thereto.

The sawslot is, as a rule, of throughgoing construction, that is, it is open toward the needle back. Independently therefrom, dirt accumulating in the sawslot may adversely affect the operation.

Further, for example, German Patent No. 586,678 discloses a latch needle, whose sawslot is configured in a special manner for reducing its tendency to become soiled. The sawslot widens from a constriction toward both the needle breast and the needle back. The enlargement extends both in the length direction and in the transverse direction of the needle. By virtue of such a funnel-shaped enlargement toward the needle back, an accumulation of dirt is intended to be prevented or at least reduced, since dirt may more easily leave the sawslot.

In latch needles having freely movable latches, the latter may, due to rebounds or other external effects, assume an undefined position. To avoid such occurrences, latch needles provided with a spring-loaded latch have been developed. Such a latch needle is disclosed in German Patent Document DE-AS 1,113,537. The latch needle has a sawslot which widens toward the needle breast relative to the longitudinal direction of the shank. Toward the needle back the sawslot is bounded by parallel flanks. In the narrow, divergent sawslot surfaces oriented toward needle breast, spring-supporting pockets are formed for receiving the ends of a latch spring formed as a leaf spring. The latch spring is introduced into the sawslot at the needle breast, and is threaded into its desired position by means of an auxiliary tool introduced into the sawslot. The underside of the spring lies against the spring-supporting pockets and its upper side lies against the end of the latch.

For such a basic construction the sawslot must have a relatively large volume for allowing the latch spring to be threaded in. Further, the latch spring is only moderately secured in the spring-supporting pockets in the depth of the sawslot. The latch spring may slip and/or may become lost, and, as a result, the needle does no longer operate correctly.

It is therefore an object of the invention to provide an improved latch needle.

SUMMARY OF THE INVENTION

The above object generally is achieved by a latch needle according to the invention that has a sawslot which widens toward the needle back, preferably relative to the longitudinal needle direction and, if needed, also widens in the transverse direction. A latch spring is arranged in the enlarged region of the sawslot. Thus, the respective spring-supporting pockets are open toward the needle back. Therefore, the latch spring may first simply be inserted into the sawslot at the needle back and may then be secured, for example, by an embossing step. A bending of the latch spring during insertion, as described, for example in DE-AS 1,113,537, is thus not necessary. The latch needle may thus be made with high precision with narrow tolerances. The new latch needle configuration thus has significant advantages concerning manufacturing technology.

Further, the sawslot widening in the direction of the needle back in the shape of a downward open funnel, has the advantage that the tendency of dirt accumulation in the sawslot is significantly reduced, and in case of depositions, the latter may be easily eliminated from the downward open funnel by the movements of the latch.

It is an essential aspect of the present invention that the length of the sawslot at the needle back, including the possibly present spring-supporting pockets, equals at least the length of the relaxed latch spring.

Conventional latch springs may occasionally slip or entirely fall out of the latch needle. Should this happen, an orderly functioning of the latch needle is, in all probability, no longer possible. It has been found that the latch needle according to the invention, having a latch spring secured at the needle-back side, is substantially less sensitive as concerns a loss or misadjustment of the latch spring. The latch needles according to the invention permit very high knitting speeds with a high reliability.

The latch spring may be used for setting preferred latch positions. In such a case the latch has engagement faces which determine the preferred positions and which are formed as planar surfaces. Also, the latch spring has preferably an essentially elongated configuration. It may also be entirely straight. The latch spring may have, however, a more or less bent portion conforming to the end of the latch, and adjoining curved portions, for example, for merely urging the latch away from its end positions and otherwise frictionally braking it. The present inventive concept is adapted for such latch springs as well.

The latch spring is held in the sawslot preferably in a form-locking manner. Such a fixation may be effected by embossments or similar upsetting of material or by lateral, pinched locations which constrict the spring-supporting pockets toward the needle back. Such a mode of fixation is advantageous in that it permits a limited axial mobility of the latch spring and thus allows a longitudinal play thereof, so that the latch spring may move in a limited manner in the spring-supporting pockets during its springing motion. A further advantage of such a mode of fixation is the possibility to influence the spring force which is exerted by the latch spring to the latch by the position of the embossments. Thus, for example, given the same spring geometry, a soft spring effect may be obtained if the embossments are at a large distance from the latch bearing, while in case of a small distance of the embossments from the latch bearing a harder spring effect is achieved. If such property is not required, the latch spring may be secured differently, for example, by laser welding. Mixed solutions are also feasible, where the latch spring is, at one end, bonded to the shank, for example, by welding, and is, at the other end, secured in a form-locking manner. The sawslot widening toward the needle back may additionally widen toward the needle breast. In such a case the shortest location of the sawslot measured in the longitudinal direction of the needle lies between the needle back and the needle breast. Furthermore, the slot length at the needle breast may be so dimensioned that the sawslot is entirely or at least almost entirely covered by the latch toward the inner space of the needle when the latch is in its closed position. In this manner the amount of dirt entering the sawslot is reduced. Practically no gap is present through which dirt may gain access from the closed inner space of the hook into the sawslot. Further, the slot end may constitute a limit for the pivotal motion of the latch. For such a purpose, at the end of the sawslot an engagement face for the latch may be formed. The position of the engagement face is preferably arranged such that the latch abuts the engagement face just as the latch spoon too, arrives into engagement with the tip of the hook. Preferably, however, the engagement face is slightly set back with respect to such a position, so that the latch spoon may assume its position on the hook tip, while the latch is just short of contacting the engagement face at the end of the sawslot. Such a configuration has the advantage that the engagement face does not interfere with a correct closing of the hook by the latch even in case of the unavoidably appearing manufacturing tolerances. Further, such a configuration prevents the latch from assuming a position underneath the hook in case of a partially worn latch needle, whose latch has an increased lateral play. Therefore, a reliable knitting process may continue even with partially worn latch needles, thus significantly increasing the service life thereof.

Further, a shortening of the sawslot in the region of the hook at the needle breast may lead to a stiffening of the shank, thus increasing the stability of the latch needle in the region of the sawslot. In addition, the guidance of the latch in the sawslot may be improved, whereby lesser requirements can be set for the bearing arrangement of the latch. Such a guidance may be formed, for example, by pins or half-pins pressed out of the lateral slot flanks.

As concerns the reverse position of the latch, the length of the sawslot at the needle breast is so dimensioned that the latch may, in its reverse position, lie on the shank of the needle. For this purpose at the end of the sawslot an additional opening may be provided for receiving the latch spoon formed on the latch. Such openings or shaping do no longer interfere with the securing arrangement of the spring, such as the spring supporting pockets which, according to the invention, face the needle back.

Further details of advantageous embodiments of the invention are disclosed in the drawing, the description or the claims.

DETAILED DESCRIPTION OF THE INVENTION

Figure 1:
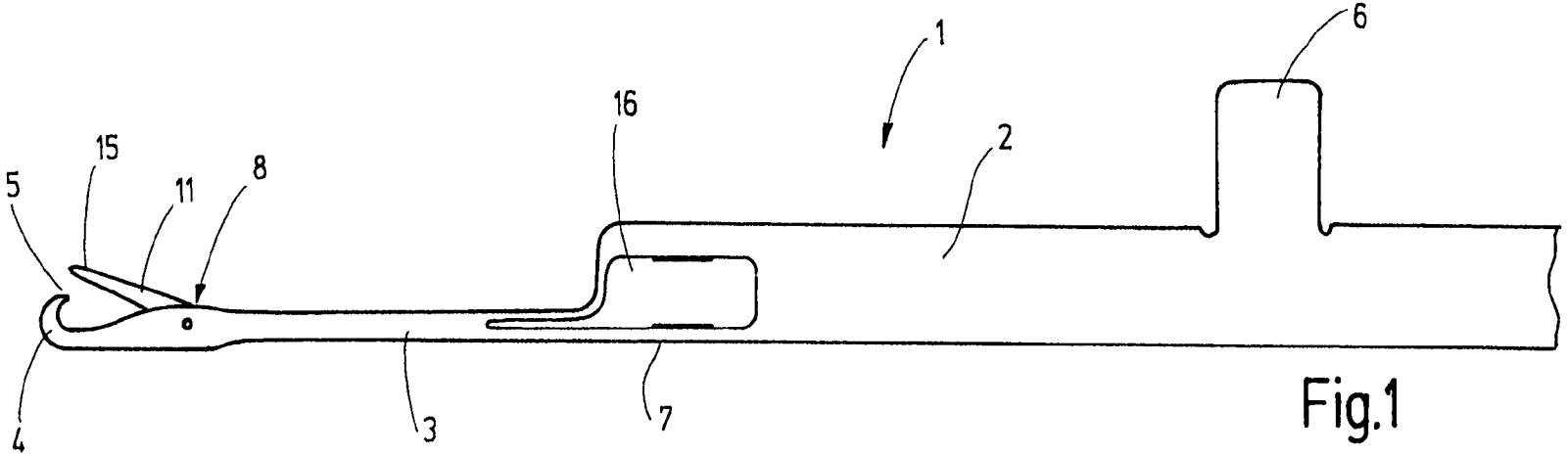
FIG. 1 is a schematic side elevational view of the latch needle according to the invention.
Figure 2:
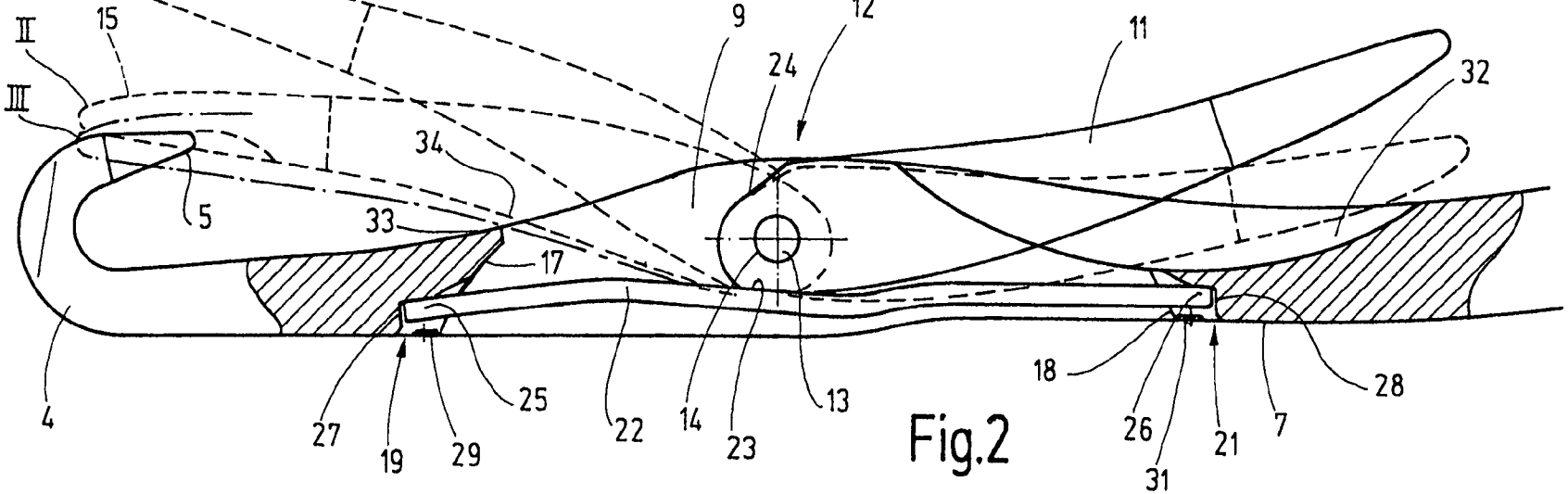
FIG. 2 is a fragmentary, partially longitudinal section of the latch needle according to FIG. 1, shown at an enlarged scale.

FIG. 1 illustrates a latch needle 1 which finds application primarily as a machine knitting needle or, in a similar configuration, as a stitch needle or the like. The latch needle 1 has a base body 2 which is flanked by two flat sides and from which a shank 3 extends. At its free end the shank 3 carries a hook 4, whose tip 5 is oriented toward the base body 2. In FIG. 2, the lower narrow side of the base body 2 and the shank 3, situated remote from the hook 4 of the latch needle 1 and its butt 6, constitutes the needle back 7. In FIG. 1, the upper narrow side of the shank 3 constitutes, at least in the immediate vicinity of the hook 4, a needle breast 8. In the region of the needle breast 8 the shank 3 is provided with a sawslot 9 visible in the sectional FIG. 2. The sawslot 9 serves for receiving one end of a latch 11, which is pivotally supported in a bearing device 12. The bearing device 12 is formed by a bearing means 13, such as a bearing pin which passes through a latch hole 14 provided at an end of the latch 11. The latch 11 may be pivoted back-and-forth, so that it may lie on the hook tip 5 with its latch spoon 15 or may be swung into its reverse position. Additional elements may be formed on the base body 2, such as a laterally mounted transfer spring 16 which is attached to the flat side of the base body 2 and which has a resilient finger, whose tip is biased against the shank 3.

Figure 5:
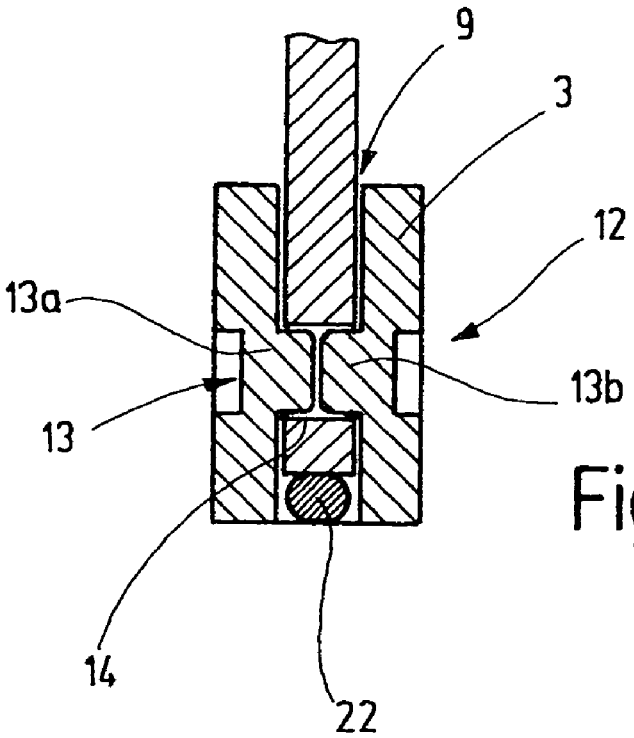
FIG. 5 is a cross-sectional view of the latch needle of FIGS. 1 and 2, shown in the zone of the bearing device for the needle.

As shown in FIG. 5, the bearing means 13 of the bearing device 12 may be divided into two half pins 13*a*, 13*b* which are pressed inward from the side flanks of the shank 3 bordering the sawslot 9 for forming the projections which extend into the latch hole 14.

A significant particularity of the latch needle 1 resides in the configuration of the sawslot 9 in which the latch 11 is pivotally supported. FIG. 2 shows several pivotal positions of the latch 11 in broken lines. As shown particularly in FIG. 2, as well as in FIGS. 3 and 4, the sawslot 9 widens toward the needle back 7. At its axially frontal as well as axially rearward ends the sawslot 9 is bounded by narrow surfaces 17, 18 which diverge from one another, that is, they form an angle which opens downward, as viewed in FIG. 2. If the surfaces 17, 18 are arcuate, the center of their radius of curvature lies preferably underneath the needle back 7.

Figure 3:
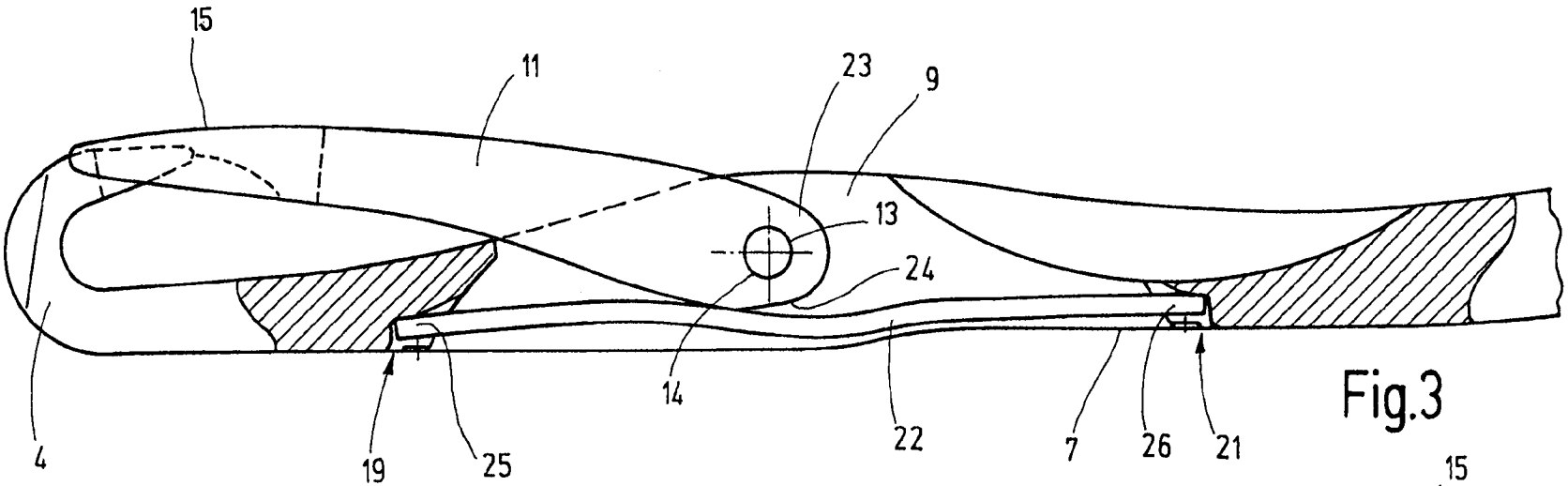
FIG. 3 shows the latch needle of FIG. 2 in a closed position.
Figure 6:
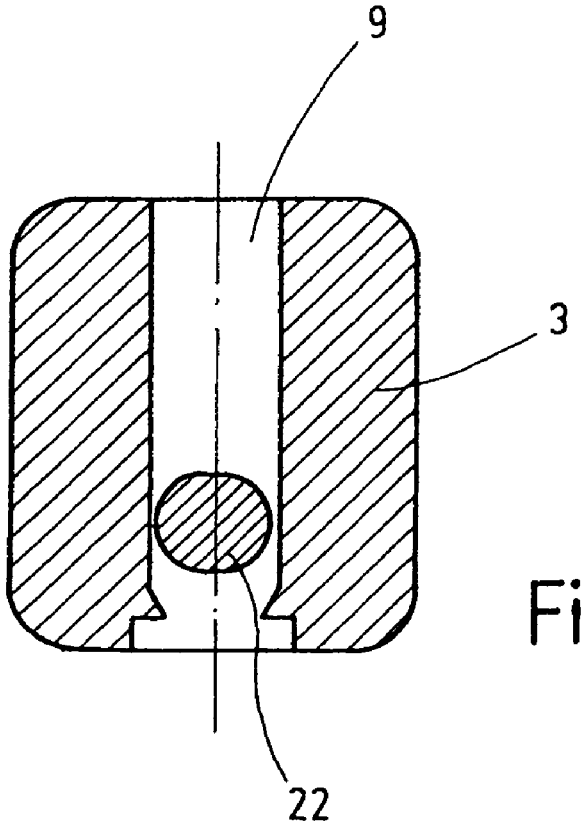
FIG. 6 is a cross-sectional view of the latch needle of FIG. 2, shown in the zone of its sawslot.

On the surfaces 17, 18 respective recesses are formed which constitute spring-supporting pockets 19, 21 serving to receive a latch spring 22. As seen in FIG. 5 or 6, the latch spring 22 has, for example, a substantially circular cross section, or, in the alternative, it may have a rectangular cross section. The latch spring 22 is made of a spring material, such as spring steel and has an essentially elongated configuration. The latch spring 22 lies, preferably under bias, with a central, preferably planar region, on that end of the latch 11 which is situated within the sawslot 9. On the latch 11 engagement faces 23, 24 may be formed which ensure a stable reverse position of the latch 11 (FIG. 4) or a stabilized position adjoining the closed position (FIG. 3).

Figure 7:
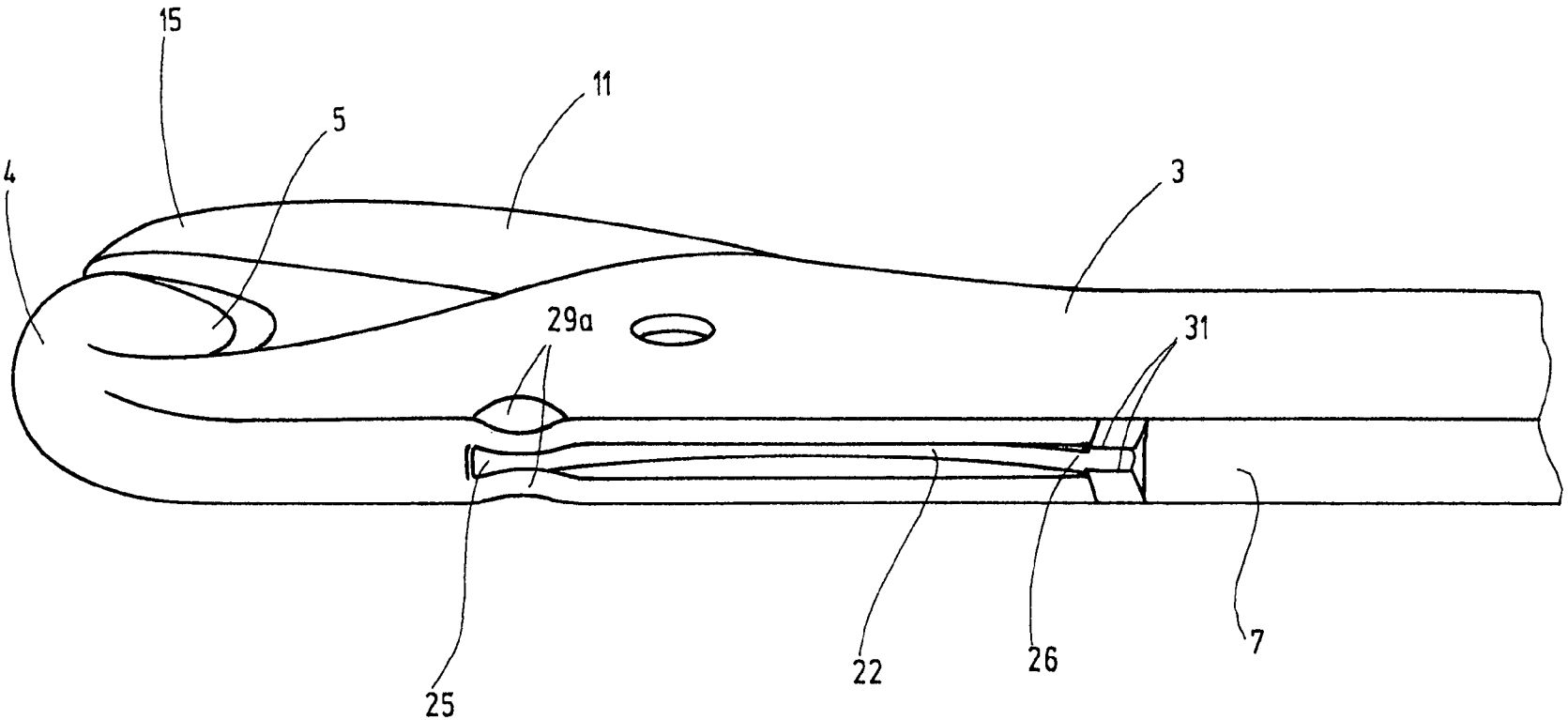
FIG. 7 is a fragmentary perspective view of a modified embodiment of the latch needle according to the invention.

The spring-supporting pockets 19, 21 are essentially open toward the needle back 7. The latch spring 22 lies with its ends 25, 26 in the spring-supporting pockets 19, 21. End faces 27, 28 which form part of the spring-supporting pockets 19, 21 and which are essentially parallel to one another and perpendicular to the longitudinal direction of the needle, are spaced from one another at a distance which is slightly greater than the length of the latch spring 22. To prevent the latch spring 22 from dropping out of the spring-supporting pockets 19, 21 and to counter-support the spring force of the latch spring 22, the spring-supporting pockets 19, 21 are closed toward the needle back 7, for example, by embossments 29, 31. Instead of embossments, laser-produced molten portions or the like may find application. As seen in FIG. 7, instead of embossments 29 lateral pinched zones 29*a* may be provided where the shank 3 is pressed together immediately at the needle back for closing the spring-supporting pocket 19. The same applies to the spring-supporting pocket 21. As illustrated, various measures may be combined for closing the spring-supporting pockets. It is also feasible to additionally provide embossments at the pinched zones 29*a*.

In the embodiment according to FIGS. 1 to 4 the spring-supporting pocket 19 has two embossments 29 which are formed on the two facing, parallel side flanks of the spring-supporting pocket 19 and are oriented to one another for reducing, at the needle back 7, the inner width between the two side flanks. The same considerations apply to the spring-supporting pocket 21 and its embossments 31. By means of the size and depth of the respective spring-supporting pockets 29, 31, measured from the needle back 7, the bias of the latch spring 22 may be regulated in the spring-supporting pockets 19, 21.

Figure 4:
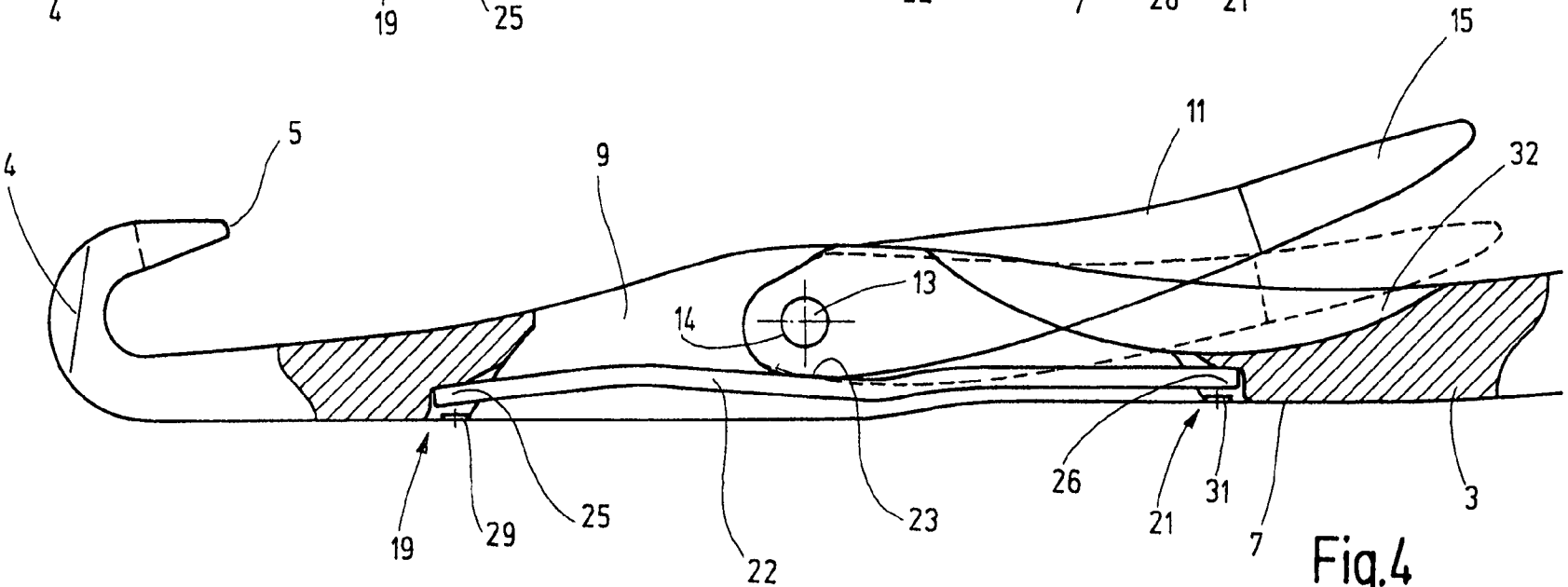
FIG. 4 shows the latch needle of FIG. 2 in a reverse position.

The sawslot 9 may also widen toward the needle breast 8 with respect to the longitudinal direction of the needle. This applies in particular to the side situated remote from the hook 4. Here the sawslot may be adjoined, for example, by an enlarged slot region 32 which, as illustrated in FIG. 4, provides for a guidance of the latch 11 into its position of engagement in which it contacts the shank 3. Such a position is shown in broken lines for the latch 11 in FIG. 4. The stable reverse position of the latch 11, in which the latter lies on the latch spring 22 with its engagement face 23, is shown in solid lines.

On the needle-breast side the sawslot 9 is, concerning its axial length and the position of its hook-side end, is dimensioned to be so long or so short that the latch 11 almost closes the sawslot 9 in the closed position. FIG. 2 shows, in a broken-line illustration I of the latch 11, the stable position of rest of the latch 11 in the vicinity of the hook 4. The engagement face 24 lies on the latch spring 22. From such a position the latch 11 may be pressed onto the hook 4 or, more precisely, onto the hook tip 5 until the inside of the latch spoon 15 of the latch 11 lies on the hook 4. Such a position of the latch 11 is indicated in broken lines at II in FIG. 2. In such a position, between the hook-side end 33 of the sawslot 9 and the position 34 of the latch 11 a clearance is present which prevents the latch 11 from touching the slot end 33. The sawslot 9 is nevertheless closed to a substantial extent, so that dirt, such as paraffin, other thread-treating agent, dust or fragments, emanating from a thread captured by the hook 4 cannot gain access to the sawslot 9.

In case the latch 11 assumes a position laterally of the tip 5 of the hook 4 because of the increasing lateral play that develops over time, and thus the latch 11 is not seated on the hook 4, or more precisely, on its tip 5, the small distance between the slot end 33 and the location of engagement 34 of the latch 11 prevents the latch 11 from arriving underneath the hook tip 5. A corresponding position III of the latch 11 is shown in broken lines in FIG. 2 and is separately illustrated in FIG. 3. It is thus seen that by virtue of such an arrangement a continued knitting is feasible with needles which no longer abut necessarily securely the tip of the hook 4. At least gross knitting errors are avoided.

The starting point of a new concept in a latch needle 1 is an attachment of the latch spring 22 in the sawslot 9 of the latch needle from the side of the needle back 7. For this purpose the latch needle 1 has spring-supporting pockets 19, 21 accessible from the needle back 7 or other structures adapted to receive the ends 25, 26 of the latch spring 22. The spring-supporting pockets 19, 21 are closed toward the needle back 7 at least to such an extent that the ends 25, 26 of the latch spring 22 are held in a form-locking, or at least in a captive manner in the spring-supporting pockets 19, 21. Such a latch needle has a reduced tolerance sensitivity during manufacture. The described needle concept makes possible further improvements which contribute to the operational safety and service life of the latch needle.

It will be appreciated that the above description of the present invention is susceptible to various modifications, changes and adaptations, and the same are intended to be comprehended within the meaning and range of equivalents of the appended claims.

LIST OF REFERENCE CHARACTERS

1 latch needle
2 base body
3 shank
4 hook
5 tip
6 butt
7 needle back
8 needle breast
9 sawslot
11 latch
12 bearing device
13 bearing means
14 needle hole
15 latch spoon
16 transfer spring
17, 18 surfaces
19, 21 spring-supporting pockets
22 latch spring
23, 24 engagement faces
25, 26 ends
27, 28 end faces
29, 31 embossments
29*a* pinched zones
32 slot region
33 slot end
34 engagement face, location

What is claimed is:

1. A latch needle for a knitting machine comprising a shank, on which a hook and a sawslot are formed; the shank has a needle breast and a needle back between which the sawslot extends; the sawslot widens toward the needle back, a latch pivotally supported in the sawslot, and a latch spring arranged in that region of the sawslot which widens toward the needle back.

2. The latch needle as defined in claim 1, wherein in the sawslot, spring-supporting pockets are arranged which are open toward the needle back.

3. The latch needle as defined in claim 1, wherein the latch spring is held in the sawslot in a form-locking manner.

4. The latch needle as defined in claim 1, wherein the latch spring is held in the sawslot by at least one embossment.

5. The latch needle as defined in claim 1, wherein the sawslot widens toward the needle breast.

6. The latch needle as defined in claim 1, wherein the latch spring is arranged in the sawslot between a constriction, measured in the longitudinal shank direction, and the needle back.

7. The latch needle as defined in claim 1, wherein the sawslot is bounded by side flanks, and, for a pivotal support of the latch, a latch bearing device is provided, having at least one bearing means which is constituted by a pin formed by a plastic deformation of a side flank.

8. The latch needle as defined in claim 1, wherein the sawslot has, for the latch, an engagement face which is located at the sawslot side adjoining the needle breast and which is oriented toward the hook.

9. A machine knitting latch needle comprising:

a shank, on which a hook and a sawslot are formed with the shank having a needle breast and a needle back between which the sawslot extends, and with the sawslot widening toward the needle back in a longitudinal direction of the shank;

a latch pivotally supported in the sawslot;

a latch spring arranged in that region of the sawslot which widens toward the needle back, with each end of the spring being supported in a respective spring-supporting pocket that are arranged in opposite end walls of the sawslot, with the spring supporting pockets being open toward the needle back; and, means for holding the respective ends of the spring in the respective spring supporting pockets of the sawslot.

10. The latch needle as defined in claim 9, wherein the means for holding the respective ends of the latch spring in the respective pockets of the sawslot includes at least one embossment formed on a pocket side wall in each of the spring supporting pockets.

11. The latch needle as defined in claim 9, wherein the sawslot widens toward the needle breast in a direction transverse to the longitudinal direction.

12. The latch needle as defined in claim 9, wherein the latch spring is arranged in the sawslot between a constriction, which is disposed in the pocket, which extends in the longitudinal shank direction and which is contacted by the latch spring, and the needle back.

13. The latch needle as defined in claim 9, wherein: the sawslot is bounded by side flanks; and, a latch bearing device is provided for a pivotal support of the latch, with the bearing device having at least one bearing constituted by a pin formed by a plastic deformation of at least one side flank.

14. The latch needle as defined in claim 9, wherein the sawslot has an engagement face for the latch, which face is located on the needle breast at the sawslot end that is oriented toward the hook.

15. The latch needle as defined in claim 9, wherein the spring is a substantially flat spring.

* * * * *